US009196127B2

(12) United States Patent
Lovaas et al.

(10) Patent No.: US 9,196,127 B2
(45) Date of Patent: Nov. 24, 2015

(54) KENO REDRAWS

(71) Applicant: IGT, Las Vegas, NV (US)

(72) Inventors: Paul P. Lovaas, Bozeman, MT (US); Toby F. Naylor, Belgrade, MT (US); Daniel L. DeFrance, Bozeman, MT (US)

(73) Assignee: IGT, Las Vegas, NV (US)

( * ) Notice: Subject to any disclaimer, the term of this patent is extended or adjusted under 35 U.S.C. 154(b) by 108 days.

(21) Appl. No.: 14/012,940

(22) Filed: Aug. 28, 2013

(65) Prior Publication Data

US 2015/0065222 A1 Mar. 5, 2015

(51) Int. Cl.
*G07F 17/32* (2006.01)
*A63F 3/06* (2006.01)

(52) U.S. Cl.
CPC ..... *G07F 17/3286* (2013.01); *A63F 3/0645* (2013.01)

(58) Field of Classification Search
CPC ..... B07F 17/32; B07F 17/3209; G07F 17/32; G07F 17/3209; A63F 3/062; A63F 3/06; A63F 3/0605; A63F 3/0645
See application file for complete search history.

(56) References Cited

U.S. PATENT DOCUMENTS 4,033,588 A 7/1977 Watts
4,611,811 A 9/1986 Haase
4,661,906 A 4/1987 DiFrancesco et al.
4,711,454 A 12/1987 Small
4,747,600 A 5/1988 Richardson
4,775,155 A 10/1988 Lees
4,798,387 A 1/1989 Richardson
4,875,686 A 10/1989 Timms
5,005,840 A 4/1991 Schwartz
5,043,887 A 8/1991 Richardson
5,046,737 A 9/1991 Fienberg
5,072,381 A 12/1991 Richardson et al.
5,100,139 A 3/1992 Di Bella
5,116,049 A 5/1992 Sludikoff et al.
5,158,293 A 10/1992 Mullins
5,351,970 A 10/1994 Fioretti
5,401,024 A 3/1995 Simunek
5,419,592 A 5/1995 Stuart
5,482,289 A 1/1996 Weingardt
5,569,083 A 10/1996 Fioretti
5,586,937 A 12/1996 Menashe
5,639,089 A 6/1997 Matsumoto et al.
5,647,798 A 7/1997 Falciglia
5,651,735 A 7/1997 Baba
5,679,077 A 10/1997 Pocock et al.
5,687,971 A 11/1997 Khaladkar
5,718,631 A 2/1998 Invencion
5,727,786 A 3/1998 Weingardt
5,743,526 A 4/1998 Inoue
5,755,619 A 5/1998 Matsumoto et al.
5,779,545 A 7/1998 Berg et al.
5,813,911 A 9/1998 Margolin
5,823,534 A 10/1998 Bayai et al.

(Continued)

*Primary Examiner* — Jay Liddle
*Assistant Examiner* — Alex F. R. P. Rada, II
(74) *Attorney, Agent, or Firm* — Neal, Gerber & Eisenberg LLP

(57) ABSTRACT

A keno game may be provided during which at least some of the drawn numbers are redrawn. A keno board may display a set of available numbers. Upon the player's selection of numbers on the keno board, a set of drawn numbers may be generated. The drawn numbers that match the player selected numbers may be locked on the keno board, while the generated numbers that are not matches may re-drawn.

23 Claims, 10 Drawing Sheets

(56) References Cited

U.S. PATENT DOCUMENTS 5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,945,655 A 8/1999 Gilgeous et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A 8/2000 Scott et al.
6,146,272 A 11/2000 Walker et al.
6,168,521 B1 1/2001 Luciano et al.
6,183,361 B1 2/2001 Cummings et al.
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 11/2001 Roethel et al.
6,315,291 B1 11/2001 Moody
6,325,716 B1 12/2001 Walker et al.
6,358,151 B1 3/2002 Enzminger et al.
6,364,313 B1 * 4/2002 Moody ..... 273/138.1
6,368,213 B1 4/2002 McNabola
6,368,214 B1 4/2002 Luciano
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,607,440 B2 8/2003 Santini, Jr.
6,609,973 B1 8/2003 Weiss
6,645,072 B1 11/2003 Kellen
6,656,044 B1 12/2003 Lewis
6,656,045 B2 12/2003 Wei et al.
6,722,655 B1 4/2004 Camero
6,755,738 B2 6/2004 Glasson et al.
6,755,739 B2 6/2004 Santini, Jr.
6,780,108 B1 8/2004 Luciano et al.
6,802,776 B2 10/2004 Lind et al.
6,824,465 B2 11/2004 Luciano, Jr.
6,832,956 B1 12/2004 Boyd et al.
6,840,858 B2 1/2005 Adams
7,258,608 B2 8/2007 Khal
7,303,469 B2 12/2007 Kaminkow
7,306,519 B2 12/2007 Baerlocher
7,399,227 B2 7/2008 Michaelson et al.
7,544,129 B2 6/2009 Baerlocher
7,682,241 B2 3/2010 Baerlocher
7,824,257 B2 11/2010 Jubinville et al.
7,901,282 B2 * 3/2011 Cannon ..... 463/18
8,025,561 B2 9/2011 Reddicks et al.
8,668,569 B2 * 3/2014 Gilbertson et al. ..... 463/18
2002/0045472 A1 4/2002 Adams
2002/0052231 A1 5/2002 Fioretti
2002/0094859 A1 7/2002 Hirsch et al.
2002/0098883 A1 7/2002 Packes et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0017867 A1 1/2003 DeKeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.
2005/0059449 A1 3/2005 Yarbrough
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0130730 A1 6/2005 Lind et al.
2005/0148382 A1 7/2005 Fox
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0227753 A1 10/2005 Luciano, Jr.
2005/0255906 A1 11/2005 Lind et al.
2006/0084490 A1 4/2006 Khal
2006/0189375 A1 8/2006 Dodge
2007/0021185 A1 1/2007 Walker et al.
2007/0060287 A1 * 3/2007 Reddicks et al. ..... 463/19
2007/0117611 A1 5/2007 Dodge
2007/0184887 A1 * 8/2007 Cannon ..... 463/16
2007/0191086 A1 * 8/2007 Huang ..... 463/17
2008/0102952 A1 5/2008 Walker et al.
2008/0254894 A1 10/2008 Michaelson et al.
2009/0075715 A1 3/2009 Coleman et al.
2009/0197664 A1 * 8/2009 Schultz ..... 463/18
2010/0120489 A1 5/2010 Meyer
2011/0028201 A1 2/2011 Warner et al.
2012/0220356 A1 * 8/2012 Gilbertson et al. ..... 463/18

* cited by examiner

KENO REDRAWS

BACKGROUND

The present disclosure relates generally to wager-based games and more particularly to keno games. A keno game typically displays to a player a keno board with eighty numbered selection spots. A player wagers by selecting six numbers on the keno board. Next, twenty numbers are drawn from eighty possible numbers. The player is paid based on matches found between the drawn numbers and the six player-selected numbers on the keno board. For example, the player may have selected numbers 5, 21, 34, 36, 49, and 71 of which 5 and 21 match the numbers drawn by the keno game. A paytable may dictate the payout amount that is due to the player depending on the number of matches detected. For example, a paytable may indicate that if there are four matches, then the payout amount is seven points.

SUMMARY

A method of providing a keno game during which at least some of drawn numbers are redrawn includes, but is not limited to any of the combination of: displaying a keno board having a set of available numbers; receiving a player selection of a player selected sub-set of numbers from the set of available numbers; selecting, using one or more processors, a first set of drawn numbers from the set of available numbers; updating the display of the keno board to indicate the selection of the first set of drawn numbers; updating the display of the keno board to indicate that a subset of the first set of drawn numbers are un-selected from the keno board, wherein the numbers in the subset of the displayed first set of drawn numbers are not matches with the numbers in the player selected subset of numbers; selecting, using the one or more processors, a second set of drawn numbers; and updating the display of the keno board to indicate the selection of the second set of drawn numbers.

An electronic device for playing a keno game including: a display configured to display the keno game to a player having a keno board with a first predetermined number of keno board spots; a user-input panel; and a game controller having one or more data processors and one or more storage devices storing instructions that, when executed by the one or more data processors, cause the one or more data processors to perform operations including: displaying a keno board having a set of available numbers; receiving a player selection of a player selected sub-set of numbers from the set of available numbers; selecting a first set of drawn numbers from the set of available numbers; updating the display of the keno board to indicate the selection of the first set of drawn numbers; updating the display of the keno board to indicate that a subset of the first set of drawn numbers are un-selected from the keno board, wherein the numbers in the subset of the displayed first set of drawn numbers are not matches with the numbers in the player selected subset of numbers; selecting a second set of drawn numbers; and updating the display of the keno board to indicate the selection of the second set of drawn numbers.

A computer-readable storage medium having machine instructions stored therein, the instructions being executable by a processor to cause the processor to perform operations including: displaying a keno board having a set of available numbers; receiving a player selection of a player selected sub-set of numbers from the set of available numbers; selecting a first set of drawn numbers from the set of available numbers; updating the display of the keno board to indicate the selection of the first set of drawn numbers; updating the display of the keno board to indicate that a subset of the first set of drawn numbers are un-selected from the keno board, wherein the numbers in the subset of the displayed first set of drawn numbers are not matches with the numbers in the player selected subset of numbers; selecting a second set of drawn numbers; and updating the display of the keno board to indicate the selection of the second set of drawn numbers.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1A:
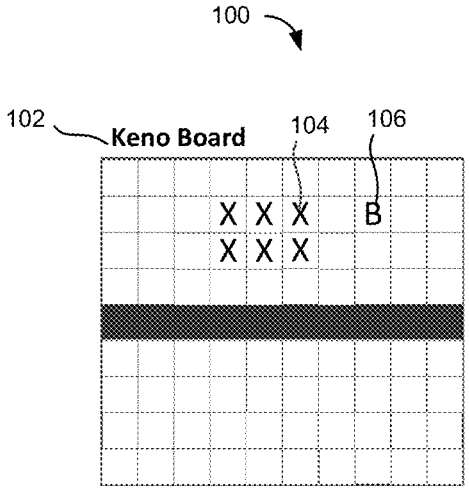
FIGS. 1A-D are illustrations of a keno game in which a redraw bonus triggers redrawing of drawn numbers that do not match any of the player selected keno board numbers, in an accordance with an example implementation.

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

During a keno game, the player may select and mark spots on a keno board shown to the player on an electronic display of a gaming machine or the player's computing device. The player selected keno board spots may be numbers selected by the player, which are a sub-set of the total set of available numbers. For example, the total set of available numbers may include eighty unique numbers (i.e., numbers from one to eighty) and the sub-set of numbers selected by the player may be six numbers. The set of available numbers may be shown on the keno board as numbered balls, numbered squares or any other visual representation. Once the player selects the sub-set of numbers, the keno game randomly selects a set of numbers from the available set of numbers. For example, twenty randomly selected numbers may be selected and displayed to the player. The randomly selected numbers may be shown to the player as "ball drops". After each number in the set of numbers is randomly selected, it may be removed from the set of available numbers and may not be available to be selected again until another keno game.

According to various embodiments disclosed herein, a keno game allowing for at least some of the drawn numbers to be redrawn is provided. During the keno game, after the player selects keno board spots (i.e., selects a set of numbers from a set of available numbers which may be shown on the keno board as numbered balls), twenty numbers (or another number of numbers) are drawn. The drawn numbers may be randomly selected by the keno game from a set of available numbers (e.g., one through eighty). The spots that are selected by the player are numbers that are a sub-set of the total set of available numbers (e.g., selection of six numbers from a set of eighty available numbers from one through eighty).

A redraw bonus may trigger redrawing of at least some of the drawn numbers that were not "hits" (i.e., drawn numbers that did not match the player selected keno board spots). The redraw bonus may be triggered when a redraw bonus spot on the keno board matches one of the drawn numbers. In some embodiments, the redraw bonus spot may be a spot on the keno board that is randomly selected (or selected by the player) prior to the selection of the drawn numbers. The selection of the redraw bonus spot on the keno board may occur before or after the player selects spots on the keno board. The redraw bonus spot may be a redraw bonus number that is randomly selected from the set of available numbers. The redraw bonus number may be visually emphasized to the player by changing the color or another visual feature associated with the keno board spot (e.g., the ball associated with the redraw bonus spot) corresponding to the redraw bonus number on the keno board.

When a redraw bonus is triggered, some or all of the drawn numbers that are not "hits" are removed from the keno board. During the redraw bonus, the "hits" are "locked" in place on the keno board (i.e., the drawn numbers that are "hits" are not removed from the keno board and may be visually highlighted or emphasized to the player). Some or all of the drawn numbers that are not "hits" are "un-selected" from the keno board. "Un-selection" from the keno board may involve changing the color of the keno board spots or another visualization feature associated with the keno board spots corresponding to the drawn numbers that are not "hits" to indicate that these keno board spots are no longer considered "drawn". For example, the color of the balls associated with these keno board numbers may be changed back to the color of the rest of the keno board spots that are not shown as drawn.

After the keno board spots that are not "hits" are "un-selected" from the keno board, a new bonus spot may be selected (e.g., selected randomly or by the player) and placed on the keno board. The number of "un-selected" drawn numbers are re-drawn and displayed on the keno board. If the redraw bonus is triggered again, the process of redrawing drawn numbers that are not "hits" is repeated. The player may be paid based on the total number of matches of player selected keno board spots and all the drawn and re-drawn numbers.

In some embodiments, the redraw bonus may involve more than one keno board spot selected. For example, three bonus spots may be randomly selected from a set of available numbers and marked on the board. In these embodiments, if any of the drawn numbers match any of the three bonus spots, the redraw bonus may be triggered, and some or all of the drawn numbers that are not "hits" may be redrawn. The redrawing may be repeated for each bonus spot that matches one of the drawn numbers. The keno game may be over once all the redraws are completed. In other embodiments, the player may place an extra bet, which allows them to "un-select" some of the drawn numbers that were not "hits".

In some embodiments, during a redraw bonus, a subset of the drawn numbers that are not "hits" are un-selected from the keno board (as opposed to all the drawn numbers that are not "hits"). For example, if ten of twenty drawn numbers were not "hits", the corresponding balls or other objects (if used on the keno board) on the keno board are visually updated. In this example, the color (or any other visual feature) of the corresponding balls may change. In these embodiments, this subset of drawn numbers may be determined at least in part as a result of a ball or another object being placed on the keno board (e.g., animation of a ball landing on top the keno board or hitting one of the sides of the keno board). A particular shape (e.g., rectangle) may be drawn around the ball that is placed on the keno board with a predetermined size (e.g., a rectangle with a predetermined radius). The drawn numbers that are not "hits" that appear outside of this shape remain selected on the keno board, while all the drawn numbers that are not "hits" that appear inside this shape are cleared (i.e., un-selected) from the keno board and redrawn. In other embodiments, all drawn numbers that are not "hits" are removed the keno board and redrawn. In other embodiments, the player may be provided with an option to redraw some of the drawn numbers, and the "un-selected" drawn numbers may be randomly redrawn.

FIGS. 1A-D illustrate a keno game 100 in which a redraw bonus triggers redrawing of all of the drawn numbers that are not "hits". A keno board 102 is displayed with eighty keno board spots. Each spot in the keno board 102 is shown as a separate square. Although the keno board spots are not numbered in FIGS. 1A-D, they can be numbered with unique numbers from one to eighty. The keno board spots can be shown in any other manner (e.g., as balls instead of squares, or as numbers without any shapes around them). One or more paytables for calculating payout to the player and summary payout information may be shown. The summary payout information may include information about the payout earned by the player during redraw bonus.

As illustrated, the player has selected six spots (e.g., keno board spot 104) on the keno board 102. A redraw bonus spot 106 is also marked on the keno board 102. As shown, the redraw bonus spot 106 is shown as a capital letter "B" inside a square associated with the spot 106. However, any other visual indicators may be used to signify that a keno board spot is a redraw bonus spot. For example, the redraw bonus spot 106 may be indicated with a color, character, icon, or other distinguishing feature drawn inside the square that corresponds to the bonus keno board spot on the keno board 102.

The redraw bonus spot 106 may be selected and marked before or after the player selects keno board spots. In some embodiments, a redraw bonus spot may be randomly selected from all the keno board spots (e.g., from eighty keno board spots) on the keno board or from the keno board spots excluding the keno board spots selected by the player. In other embodiments, the player is allowed to select the redraw bonus spot and mark it on the keno board.

Although only one redraw bonus spot 106 is selected and shown in FIG. 1A, any number of redraw bonus spots may be selected and marked on the keno board 102. For example, three redraw bonus spots may be selected and marked. When multiple redraw bonus spots are selected, the keno game may determine if any of the redraw bonus spots match any of the drawn numbers, and the number of redraws may be determined by how many redraw bonus spots are hits". In some embodiments, one redraw may occur for every redraw bonus spot that "hit". If one redraw bonus spot is a "hit", the "hits" may be "locked" in place (i.e., the "hits" remain visually shown as "hits" on the keno board), and some or all of the drawn numbers that are not "hits" are "un-selected" from the board. In some embodiments, new redraw bonus spots are not selected during the bonus. The "un-selected" drawn numbers may be randomly re-drawn. This process may be repeated for each redraw bonus spot that was a "hit" during the initial game, and the game is over once all the redraws have been completed.

Figure 1B:
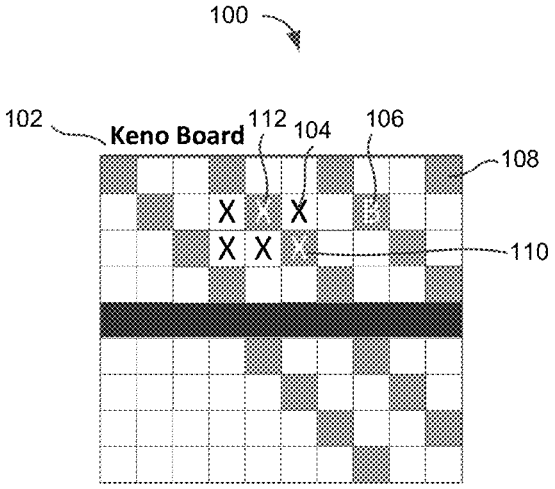

FIG. 1B further illustrates that after the player selected keno board spots and the redraw bonus spot are marked on the keno board 102, twenty numbers are drawn and marked on the keno board 102. As shown, the drawn numbers are indicated on the keno board 102 as grey colored squares (e.g., labeled as 108, 110, and 112). For example, the keno board spot labeled as 108 was selected as one of the drawn numbers. The keno board spot 108 was not selected by the player, and, as a result, this drawn number is not a "hit". In contrast, the drawn keno board spots 110 and 112 each match a player selected keno board spot. Two of the six keno board spots selected by the player match the drawn numbers. Any other visual indicators may be utilized to display to the player the drawn numbers on the keno board. Although specific keno board spots are colored with grey color to indicate the drawn keno board spots, any other combination of keno board spots can be selected as drawn keno board spots.

Figure 1C:
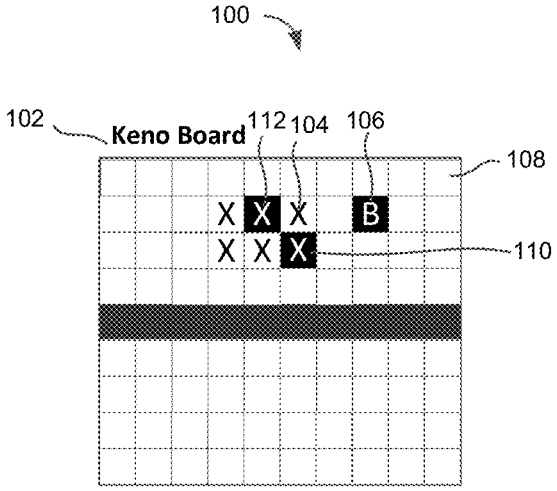

After keno board spots are drawn and marked on the keno board as shown in FIG. 1B, the drawn spots that are not "hits" (i.e., do not match the player selected keno board spots) are removed from the keno board 102 as further illustrated in FIG. 1C. As shown, seventeen of the drawn numbers are "un-selected" from the keno board 102. In particular, the "un-selection" of the drawn keno board numbers from the keno board is shown by changing the color of the drawn keno board spots back to white color to match the rest of the keno board spots. The "un-selection" of the drawn keno board spots can be visually displayed to the player in any other fashion. As shown, the drawn keno board spots 110 and 112, which were "hits" remain on the keno board or are "locked" in place (i.e., not "un-selected" from the keno board and shown as black squares with "X" indicator inside). The redraw bonus spot 106 also remains on the keno board 102 after the drawn keno board spots that were not "hits" are removed from the keno board 102.

Figure 1D:
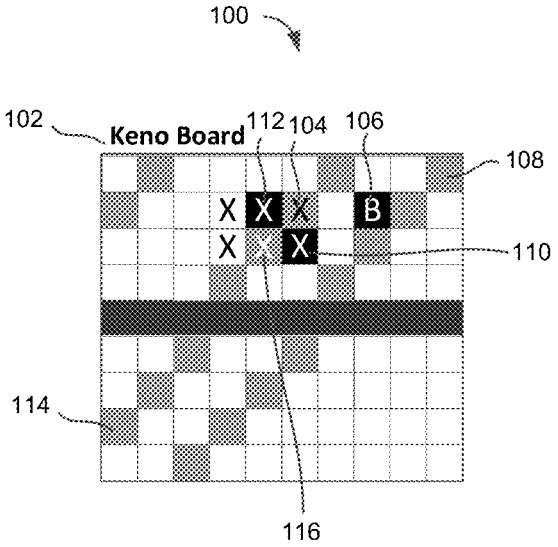

Now referring to FIG. 1D, redrawing of the "un-selected" drawn numbers is illustrated. The redraw bonus spot, the player selected keno board spots, and the drawn keno numbers 110 and 112 that were "hits" during the original keno game are still displayed. In addition, seventeen new redrawn keno board spots are marked. These new redrawn keno spots are randomly selected numbers from the available keno board numbers. The available keno board spots may exclude the number associated with the redraw bonus keno spot 106 and the numbers that correspond to the keno board spots 110 and 112 that are marked as "hits" from the original keno game. As shown, one of the newly drawn keno numbers shown on the keno board spot 114 does not match any of the player selected keno board spots. However, the keno board spots 104 and 116 match the player selected spots. As a result of the original game and the redraw bonus, four out of six of the player selected spots match the drawn numbers.

As shown in FIGS. 1A-D, all the drawn numbers that were not "hits" were "un-selected" from the keno board and redrawn. In contrast, FIGS. 2A-D provide illustrations of a keno game 200 in which some, but not all, drawn numbers that are not "hits" are redrawn. In FIGS. 2A-D, a keno board 202 is displayed with eighty keno board spots. Similar to the keno board 102, each spot in the keno board 202 is shown as a separate white square. Although the keno board spots are not numbered in FIGS. 2A-D, they can be numbered with unique numbers from one to eighty. The keno board spots can be shown in any other manner (e.g., as balls instead of squares).

Figure 2A:
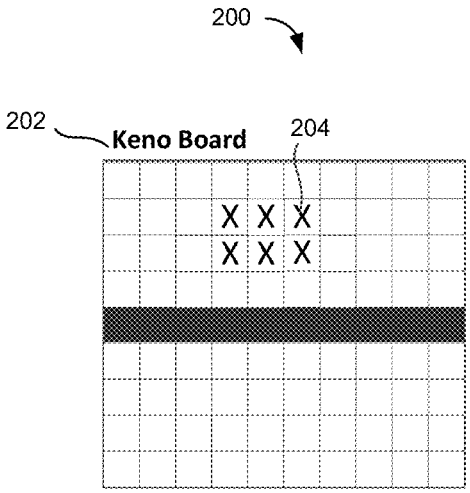
FIGS. 2A-D are illustrations of a keno game, which allows for redrawing of at least some of the drawn numbers that do not match the player selected keno board numbers, in an accordance with an example implementation.
Figure 2B:
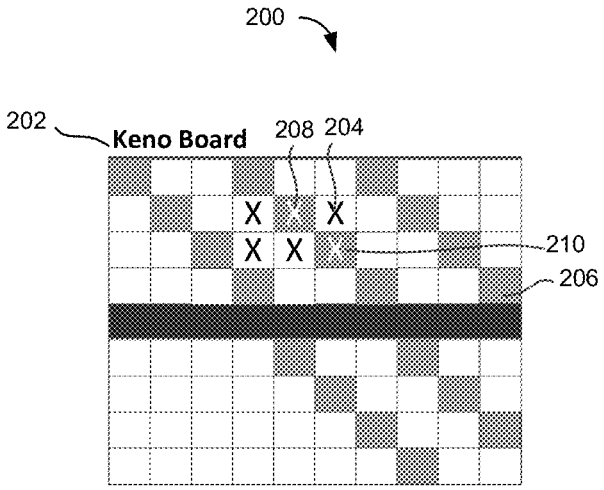

As illustrated, the player has selected six spots (e.g., keno board spot selection 204) on the keno board 202. In contrast to FIG. 1A, a triggering event (e.g., a redraw bonus spot that matches one of the drawn numbers) is not utilized in the keno game 200 to trigger the redrawing of the drawn numbers. FIG. 2B further illustrates nineteen numbers drawn and marked on the keno board 202. As shown, the drawn numbers are indicated on the keno board 102 as grey colored squares (e.g., labeled as 206, 208, and 210). For example, the keno board spot labeled as 206 was selected as one of the drawn numbers. The keno board spot 206 was not selected by the player, and, as a result, this drawn spot is not a "hit". In contrast, the drawn keno board spots 208 and 210 match player selected keno board spots. As a result, two of the six keno board spots selected by the player match the drawn numbers. Any other visual indicators may be utilized to display to the player the drawn numbers on the keno board as well as the player keno board selections. Although specific keno board spots are colored with grey color to indicate the drawn keno numbers, any other combination of keno board spots can be selected as drawn keno board spots.

Figure 2C:
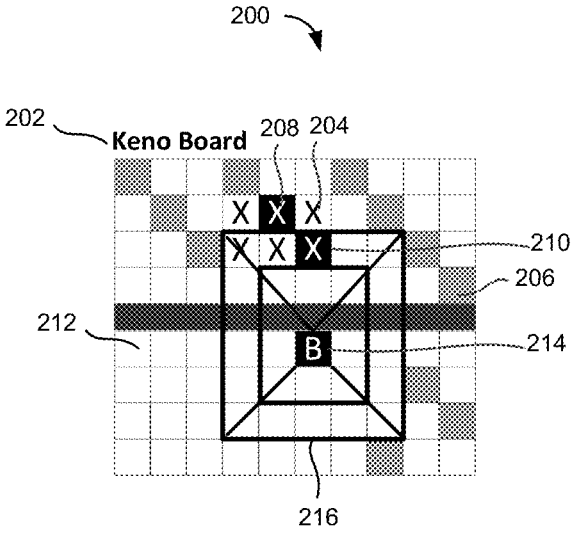

FIG. 2C illustrates that the last drawn number 214 is placed on the keno board 202 and is shown as a black colored square with "B" inside. Any other visualization of the last drawn keno number may be used to visually emphasize it to the player. As shown, two rectangles 216 are drawn around the last drawn number 214. In some embodiments, the rectangles 216 are not displayed to the player.

All the drawn numbers (i.e., a total of six drawn numbers) that appeared inside the rectangles 216 may be "un-selected" from the keno board 202, while the drawn numbers that are not within the rectangles 216 remain on the keno board 202. The "un-selection" of the drawn keno board spots from the keno board is shown by changing the color of the drawn keno board spots back to white color to match the rest of the keno board spots. The "un-selection" of the drawn keno board spots can be visually displayed to the player in any other fashion. As shown, the drawn keno board spots 208 and 210, which were "hits" remain on the keno board or are "locked" in place (i.e., not removed from the keno board and shown as black squares with "X" indicator inside).

Figure 2D:
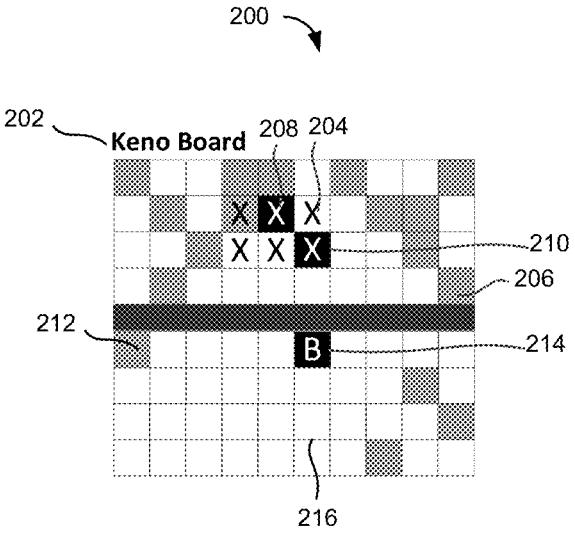

FIG. 2D illustrates redrawing of the six "un-selected" drawn numbers. As shown, six newly redrawn keno board spots are marked on the keno board 202. These new redrawn keno spots may be randomly selected from the available keno board spots, which may exclude the keno board spots 208 and 210 that remained marked as "hits" from the original keno game and the last drawn number 214 from the original game. As a result of redrawing six of keno board spots, one of the redrawn spots matches player selected keno board spot. Accordingly, from the original game and the redrawing of some of the drawn keno board spots, three out of six of the player selected spots match the drawn numbers.

In some implementations, the keno game may be a construction theme game in which the final drawn number in the original keno game (e.g., the number 214) or an additional drawn number is displayed as a wrecking ball that sends shockwaves of a given radius (i.e., shown as rectangles 216) when it lands on the keno board. Any drawn numbers within the shockwave that did not "hit" are knocked off the keno board, and the removed drawn numbers are then randomly redrawn in the construction themed game.

Bonus spots may be shown as mini wrecking balls, and the hits could be visually "nailed" or riveted in place. The wrecking ball may be animated and may swing into the side of the keno board to remove draws. However, any other game theme can be used with the redrawing keno board spots mechanism discussed herein. For example, an earthquake theme that shakes the keno board to remove the missed drawn balls. In another example, a car racing theme where a car drives across the keno board dislodges the missed drawn balls. In another example, an equestrian theme can be utilized with a horse that kicks the board to dislodge the missed drawn balls. Other examples, include but are not limited to, a window squeegee, a "take 2" movie clapper, a tornado/windblast, a huge ball (splatter, shock wave, crater) that covers a particular region of the keno board, and so on.

Figure 3:
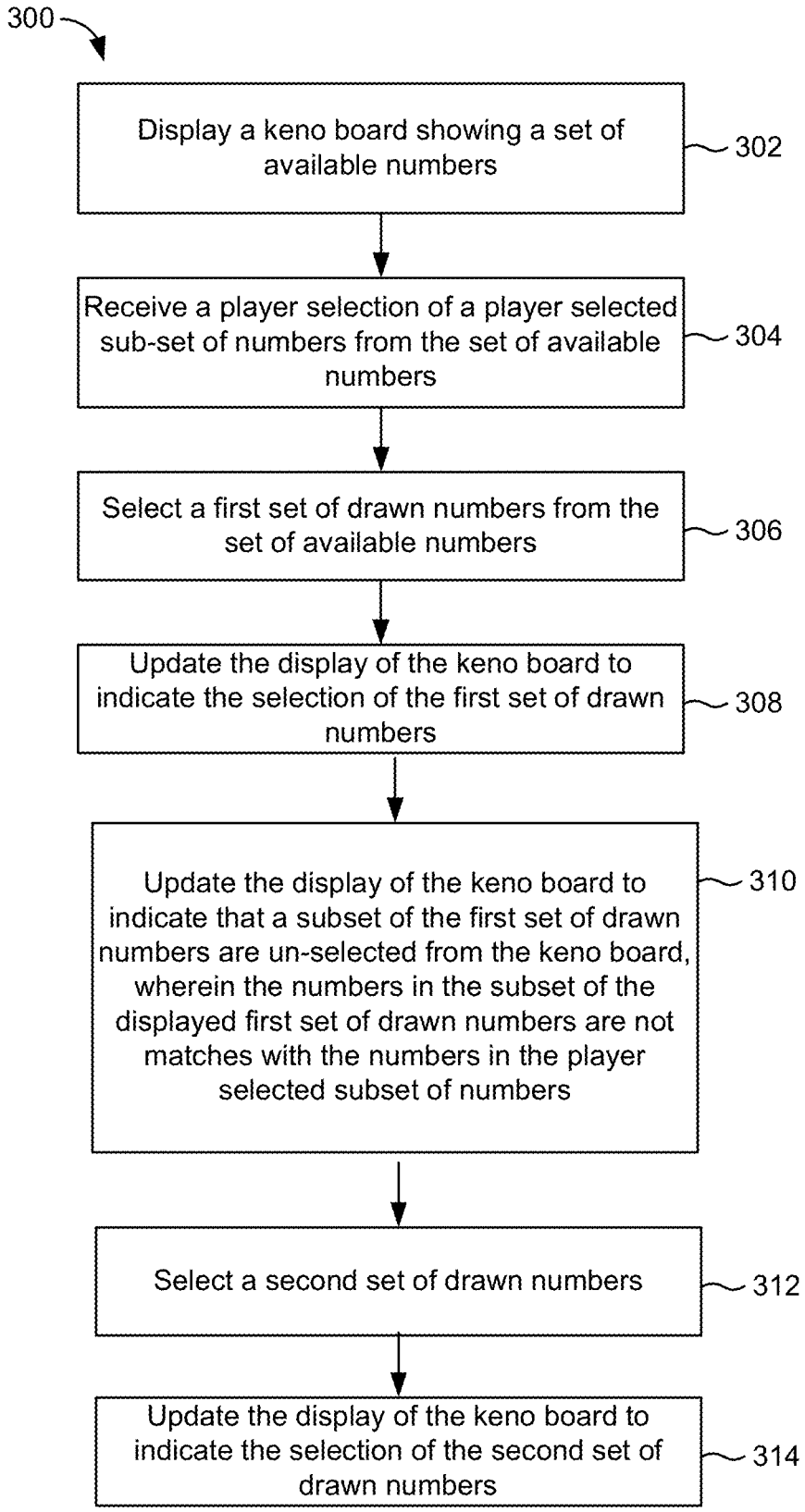
FIG. 3 is a flow diagram of a process for providing a keno game that allows for redrawing of drawn numbers, in an accordance with an example implementation.

FIG. 3 is a flow diagram of a process 300 for providing a keno game that allows for redrawing drawn numbers that are not "hits" in accordance with an illustrative embodiment. The process 300 can be implemented on a computing device (e.g., a gaming machine, a user device, etc.). In one embodiment, the process 300 is encoded on a computer-readable medium that contains instructions that, when executed by the computing device, cause the computing device to perform operations of the process 300.

The process 300 includes displaying (block 302) a keno board showing a set of available numbers. The set of available numbers may be visually illustrated on the keno board as numbered balls, numbered squares, or any other numbered shapes or images, etc. For example, each keno board ball may be labeled with a unique number between one and the number of available numbers (e.g., eighty). The set of available numbers include eighty unique numbers or any other number of unique numbers (e.g., one hundred unique numbers from one to one hundred).

Player selection of a player selected sub-set of numbers from the set of available numbers is received (block 304). The player may mark their selections on the keno board (e.g., by clicking on the numbers in the keno board game). The player selected numbers may be marked as "X"s over the corresponding balls (or another shape used to display numbers on the keno board) on the keno board. The player selected numbers may include six numbers or any other number of numbers (e.g., ten numbers).

A first set of drawn numbers is selected from the set of available numbers (block 306). In some embodiments, the first set of drawn numbers may be randomly selected numbers from the available numbers. For example, twenty numbers may be randomly selected from available eighty numbers. In some embodiments, after each number is randomly selected, it may be removed from the set of available numbers and may not be available to be selected again until another keno game. In these embodiments, the first set of drawn numbers may not include any duplicates.

At block 308, the display of the keno board is updated to indicate the selection of the first set of drawn numbers. The keno board may be updated by marking the corresponding keno board spots using one or more visual indicators. For example, when the keno board spots are displayed as balls labeled with numbers, then the balls on the keno board that correspond to the first set of drawn numbers may be updated to display a different color. In one implementation, the first set of drawn numbers may be displayed on the keno board as "ball drops".

At block 310, the display of the keno board is updated to indicate that a subset of the first set of drawn numbers are "un-selected" from the keno board. The numbers in the subset of the displayed first set of drawn numbers are not matches with the numbers in the player selected subset of numbers. The drawn numbers in the first set of drawn numbers that match the player selected keno board spots may remain shown on the keno board as "hits". In some embodiments, all the drawn numbers that do not match the player selected keno board spots may be "un-selected". In other embodiments, the final drawn number or an additional drawn number(s) may be used along with one or more shapes (e.g., rectangle) drawn around or near the final drawn number or the additional drawn number(s). In these embodiments, only the drawn numbers that are inside the drawn shape(s) are visually "un-selected" from the keno board and re-drawn. The shapes may or may not be shown to the player. For example, drawn numbers that appear within a predetermined radius of the final drawn number or the additional number are removed from the keno board and redrawn.

A second set of drawn numbers is selected (block 312). The number of numbers in the second set of drawn numbers may be the same as the total number of numbers in the subset of the first set of drawn numbers. Accordingly, the drawn numbers that are un-selected from the keno board in block 310 are redrawn. The second set of drawn numbers may be randomly determined from the set of available numbers that excludes the drawn numbers from the first set of drawn numbers that matched the player selected numbers.

The display of the keno board is updated (block 314) to indicate the selection of the second set of drawn numbers. Some of the newly drawn numbers in the second set of drawn numbers may match some of the numbers selected by the player. The player may be paid based on the outcome of the original keno game and the redrawing of at least some of the originally numbers.

A bonus triggering mechanism may be utilized to trigger the redrawing of the drawn numbers that were "not hits". FIGS. 1A-D display a redraw bonus spot that is utilized to trigger redrawing of drawn numbers. In some embodiments, multiple bonus spots may be used.

In some embodiments, after all draws are completed during the original game, the player may be given an option to redraw some of the drawn numbers (e.g., by paying an extra bet), and the removed drawn numbers are then randomly selected. In other embodiments, the keno game may allow for awarding additional draws without replacement to the player.

Figure 4:
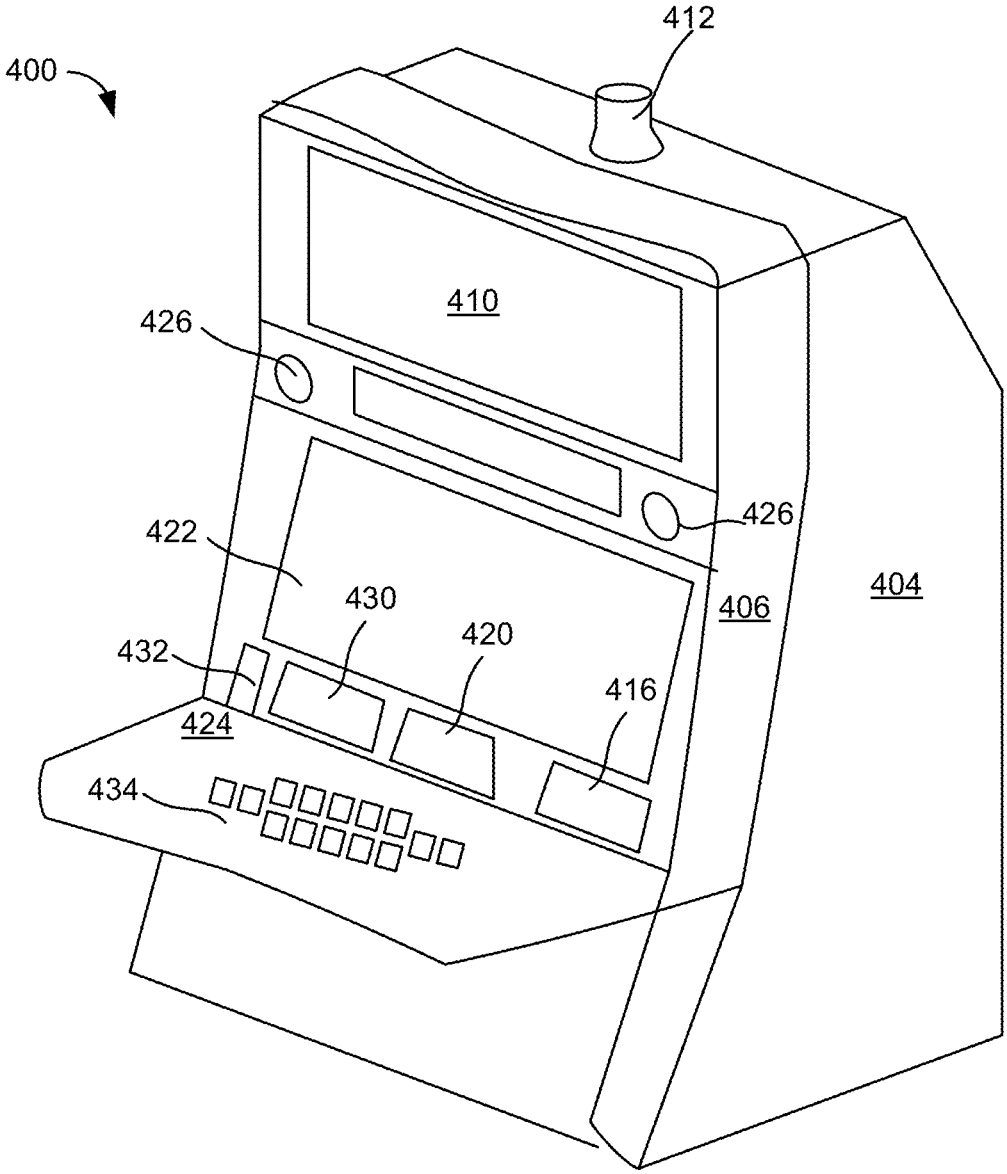
FIG. 4 is a diagram of an electronic gaming machine that can be used to play the keno game, in an accordance with an example implementation.

Referring to FIG. 4, a perspective drawing of an electronic gaming machine 400 is shown in accordance with described embodiments. The gaming machine 400 may include a main cabinet 404. The main cabinet 404 may provide a secure enclosure that prevents tampering with device components, such as a game controller (not shown) located within the interior of the main cabinet 404. The main cabinet 404 may include an access mechanism, such as a door 406, which allows the interior of the gaming machine 400 to be accessed. Actuation of the door 406 may be controlled by a locking mechanism. In some embodiments, the locking mechanism, the door 406, and the interior of main cabinet 404 may be monitored with security sensors of various types to detect whether the interior has been accessed. For instance, a light sensor may be provided within the main cabinet 404 to detect a change in light-levels when the door 406 is opened and/or an accelerometer may be attached to the door 406 to detect when the door 406 is opened.

The gaming machine 400 may include any number of user interface devices that convey sensory information to a user and/or receive input from the user. For example, the gaming machine 400 may include electronic displays 440 and/or 422, speakers 426, and/or a candle device 412 to convey information to the user of the gaming machine 400. The gaming machine 400 may also include a console 424 having one or more inputs (e.g., buttons, track pads, etc.) configured to receive input from a user. In one embodiment, the display 410 and/or the display 422 may be a touch screen display configured to receive input from a user. A controller (not shown) within the gaming machine 400 may run a game, such as a wager-based game (e.g., a keno game), in response to receiving input from a user via inputs located in the console 424, display 422, or display 410. For example, inputs located in the console 424 may be operated to place a wager in the game and to run the game. In response, the controller may cause the display 422 to show a wager-based game such as a keno game.

The gaming machine 400 may also include devices for conducting a wager-based game. For example, the gaming machine 400 may include a ticket acceptor 416 and a printer 420. In various embodiments, the gaming machine 400 may be configured to run on credits that may be redeemed for money and/or other forms of prizes. The ticket acceptor 416 may read an inserted ticket having one or more credits usable to play a game on the gaming machine 400. For example, a player of the gaming machine 400 may wager one or more credits within a video keno game. If the player loses, the wagered amount may be deducted from the player's remaining balance on the gaming machine 400. However, if the player wins and is awarded an award, the player's balance may be increased by the amount won and/or awarded. Any remaining credit balance on the gaming machine 400 may be converted into a ticket via the printer 420. For example, a player of the gaming machine 400 may cash out of the machine by selecting to print a ticket via the printer 420. The ticket may then be used to play other gaming machines or redeemed for cash and/or prizes. According to various embodiments, the gaming machine 400 may record data regarding its receipt and/or disbursement of credits.

In one embodiment, the gaming machine 400 may include a loyalty card acceptor 430. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 400. For example, a user having a loyalty account may be given an award turn on the gaming machine 400 or credited loyalty points for playing the gaming machine 400. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

when a physical item associated with a monetary value is received and identified by an acceptor, establishing, by one or more processors, a credit balance based at least in part on the monetary value associated with the received and identified physical item;

displaying, by at least one display device, a keno board having a first set of available numbers;

receiving an actuation of a wager button;

placing, by the one or more processors, a wager on a play of a keno game in response to said actuation of the wager button, said wager being deductable from the credit balance;

receiving, via at least one input device, a player selection of a player selected sub-set of numbers from the first set of available numbers;

randomly selecting, using the one or more processors, a first set of drawn numbers from the first set of available numbers;

causing, by the one or more processors, a plurality of first indications to be displayed on the keno board to indicate the selection of the first set of drawn numbers;

upon an occurrence of a triggering event, causing, by the one or more processors, one or more of the plurality of first indications to be removed from the keno board to indicate that a subset of one or more of the first set of drawn numbers are un-selected, wherein the numbers in the subset of the first set of drawn numbers are not matches with the numbers in the player selected subset of numbers;

randomly selecting, using the one or more processors, a second set of drawn numbers from a second set of available numbers, the second set of available numbers including at least one number of the subset of the first set of drawn numbers;

causing, by the one or more processors, a plurality of second indications to be displayed on the keno board to indicate the selection of the second set of drawn numbers;

determining, by the one or more processors, any awards based on any matches between the numbers in the player selected subset of numbers and the drawn numbers, the credit balance being increasable by any determined awards; and when a cashout button is actuated, initiating, by the one or more processors, a payout associated with the credit balance.

2. The method of claim 1, wherein the subset of the first set of drawn numbers includes all the drawn numbers that do not match any player selected numbers.

3. The method of claim 1, wherein the subset of the first set of drawn numbers includes some but not all of the drawn numbers that do not match any player selected numbers.

4. The method of claim 1, further comprising selecting, using the one or more processors, a keno board bonus number from the set of available numbers.

5. The method of claim 4, further comprising detecting, using the one or more processors, a match between the keno board bonus number and one of the drawn numbers in the first set of drawn numbers.

6. The method of claim 4, wherein causing the one or more of the plurality of first indications to be removed from the keno board is performed upon detection of the match between the keno board bonus number and the one of the drawn numbers in the first set of drawn numbers.

7. The method of claim 1, further comprising determining, using the one or more processors, a bonus keno board number and a bonus area surrounding the determined bonus keno board number on the keno board.

8. The method of claim 7, wherein the subset of the first set of drawn numbers that are un-selected from the keno board comprise any drawn numbers that appear in the bonus area on the keno board.

9. The method of claim 7, wherein the bonus keno board number is the last drawn number in the first set of drawn numbers.

10. The method of claim 7, wherein the bonus area surrounding the bonus keno board number is a rectangle having a first width.

11. The method of claim 1, wherein the second set of drawn numbers has the same total quantity of numbers as the subset of the first set of drawn numbers.

12. An electronic gaming machine comprising:

a housing;

a display supported by the housing and configured to display a keno game having a keno board with a first predetermined number of keno board spots;

a user-input panel supported by the housing;

an acceptor supported by the housing; and a game controller having one or more data processors and one or more storage devices storing instructions that, when executed by the one or more data processors, cause the one or more data processors to operate with the display, the user-input panel, and the acceptor to:

when a physical item associated with a monetary value is received and identified by the acceptor, establish a credit balance based at least in part on the monetary value associated with the received and identified physical item;

display a keno board having a first set of available numbers;

receive an actuation of a wager button via the user-input panel;

place a wager on a play of the keno game in response to said actuation of the wager button, said wager being deductable from the credit balance;

receive a selection of a player selected sub-set of numbers from the first set of available numbers via the user-input panel;

randomly determine a first set of drawn numbers from the first set of available numbers;

display a plurality of first indications to indicate the first set of drawn numbers on the keno board;

upon an occurrence of a triggering event, remove one or more of the plurality of first indications from the keno board to indicate that a subset of one or more of the first set of drawn numbers are un-selected, wherein the numbers in the subset of the first set of drawn numbers are not matches with the player selected subset of numbers;

randomly select a second set of drawn numbers from a second set of available numbers, the second set of available numbers including at least one number of the subset of the first set of drawn numbers;

display a plurality of second indications to indicate the second set of drawn numbers on the keno board;

determine any awards based on any matches between the numbers in the player selected subset of numbers and the drawn numbers, the credit balance being increasable by any determined awards; and when a cashout button is actuated, initiate a payout associated with the credit balance.

13. The electronic gaming machine of claim 12, wherein the subset of the first set of drawn numbers includes all the drawn numbers that do not match any player selected numbers.

14. The electronic gaming machine of claim 12, wherein the subset of the first set of drawn numbers includes some but not all of the drawn numbers that do not match any player selected numbers.

15. The electronic gaming machine of claim 12, wherein the instructions, when executed by the one or more data processors, cause the one or more data processors to select a keno board bonus number from the set of available numbers.

16. The electronic gaming machine of claim 15, wherein the instructions, when executed by the one or more data processors, cause the one or more data processors to detect a match between the keno board bonus number and one of the drawn numbers in the first set of drawn numbers.

17. The electronic gaming machine of claim 15, wherein the instructions, when executed by the one or more data processors, cause the one or more data processors to remove the one or more of the plurality of first indications upon detection of the match between the keno board bonus number and the one of the drawn numbers in the first set of drawn numbers.

18. The electronic gaming machine of claim 12, wherein the instructions, when executed by the one or more data processors, cause the one or more data processors to determine a bonus keno board number and a bonus area surrounding the determined bonus keno board number on the keno board.

19. The electronic gaming machine of claim 18, wherein the subset of the first set of drawn numbers that are unselected from the keno board comprise any drawn numbers that appear in the bonus area on the keno board.

20. The electronic gaming machine of claim 18, wherein the bonus keno board number is the last drawn number in the first set of drawn numbers.

21. The electronic gaming machine of claim 18, wherein the bonus area surrounding the bonus keno board number is a rectangle having a first width.

22. The electronic gaming machine of claim 12, wherein the second set of drawn numbers has the same total quantity of numbers as the subset of the first set of drawn numbers.

23. A non-transitory computer-readable storage medium having machine instructions stored therein, the instructions being executable by a processor to cause the processor to:

following receipt of a physical item associated with a monetary value by an acceptor and identification of the physical item by the acceptor, establish a credit balance based at least in part on the monetary value associated with the received and identified physical item cause a display device to display a keno board having a first set of available numbers;

place a wager on a play of the keno game in response to an actuation of a wager button, said wager being deductable from the credit balance;

receive a selection of a player selected sub-set of numbers from the first set of available numbers via a user-input panel;

randomly determine a first set of drawn numbers from the first set of available numbers;

cause the display device to display a plurality of first indications to indicate the determined first set of drawn numbers on the keno board;

upon an occurrence of a triggering event, cause removal of one or more of the plurality of first indications from the keno board to indicate that a subset of one or more of the first set of drawn numbers are un-selected, wherein the numbers in the subset of the first set of drawn numbers are not matches with the player selected subset of numbers;

randomly determine a second set of drawn numbers having the same total quantity of numbers as the subset of the displayed first set of drawn numbers from a second set of available numbers, the second set of available numbers including at least one number of the subset of the first set of drawn numbers;

cause the display device to display a plurality of second indications to indicate the second set of drawn numbers on the keno board;

determine any awards based on any matches between the numbers in the player selected subset of numbers and the drawn numbers, the credit balance being increasable by any determined awards; and when a cashout button is actuated, initiate a payout associated with the credit balance.

* * * * *